US006565082B2

(12) United States Patent
Sasaki et al.

(10) Patent No.: US 6,565,082 B2
(45) Date of Patent: May 20, 2003

(54) BILL RECEIVING AND DISCHARGING DEVICE AND BILL HANDLING APPARATUS

(75) Inventors: Shigeru Sasaki, Tomobe (JP); Tadashi Satou, Chiyoda (JP); Yasunari Niioka, Seto (JP); Kazushi Yoshida, Chiyoda (JP)

(73) Assignee: Hitachi, Ltd., Tokyo (JP)

( * ) Notice: Subject to any disclaimer, the term of this patent is extended or adjusted under 35 U.S.C. 154(b) by 48 days.

(21) Appl. No.: 09/930,962

(22) Filed: Aug. 17, 2001

(65) Prior Publication Data

US 2002/0096816 A1 Jul. 25, 2002

(30) Foreign Application Priority Data

Dec. 20, 2000 (JP) ..... 2000-386260

(51) Int. Cl.[7] ..... B65H 20/06
(52) U.S. Cl. ..... 271/216
(58) Field of Search ..... 271/216; 242/159, 242/167, 170, 171, 172, 346, 397, 615.4, 905; 226/196.01

(56) References Cited

U.S. PATENT DOCUMENTS 3,705,696 A * 12/1972 Edwards et al. ..... 242/346
5,153,800 A * 10/1992 Makino ..... 242/346
5,823,528 A * 10/1998 Draghetti et al. ..... 271/270

FOREIGN PATENT DOCUMENTS

JP 4-226248 * 4/1992 ..... B65H/20/06
JP 63-230467 * 10/1998 ..... G07D/9/00
JP 2000-123219 * 4/2000

* cited by examiner

*Primary Examiner*—Joseph E. Valenza
*Assistant Examiner*—Kenneth W Bower
(74) *Attorney, Agent, or Firm*—Antonelli, Terry, Stout & Kraus, LLP

(57) ABSTRACT

In a bill receiving and discharging device having a wheel for winding a tape together with a bill and a reel for winding the tape rewound from the wheel, a bill in which a cut exists at a position at which the bill cannot be held within width of the tape sometimes has a trouble such that the bill is cut into two sections at a time of discharging. In the present invention, in order to eliminate the above-described trouble, a regulating device and a discharging device for guiding an end portion of a bill to an outside of a back side region of the tape are provided.

10 Claims, 13 Drawing Sheets

BILL RECEIVING AND DISCHARGING DEVICE AND BILL HANDLING APPARATUS

BACKGROUND OF THE INVENTION

The present invention relates to a bill receiving and discharging device and a bill handling apparatus.

As a bill handling apparatus for receiving or discharging bills, there is available an apparatus provided with a bill receiving and discharging device that receives bills by winding a tape and bills on a wheel and discharges them by inversely rewinding the tape on a reel. The bill receiving and discharging device having the above-described construction offers an advantage that a small and low-cost apparatus with a simple construction can be realized. For example, in JP-A-2000-123219 specification, disclosed is a construction for receiving and discharging bills in the direction of short side of bill.

SUMMARY OF THE INVENTION

A bill receiving and discharging device that receives bills by winding a tape and bills on a wheel and discharges them by inversely rewinding the tape on a reel can handle bills of different sizes such as bills of countries in the world, and has a design capable of handling various bills mixed in size. However, a trouble caused when a cut bill is handled is not considered in the device of this type.

In the case where a cut exists at a rear end of a bill transferred in the direction of short side of the bill and at a position distant from a center of long side of the bill and on an outside of the tape edge when the bill is received, a trouble described below occurs at the time of discharging. An end portion (cut portion) of the bill wound on the wheel beyond the tape width cannot be held by the tape at the time of discharging, so that the end portion is deformed out of plane from an outer peripheral surface of the wheel.

Also, this out-of-plane deformation is also influenced by wind pressure caused by rotation of the wheel, and is promoted by it. The end portion (cut portion) greatly deformed out of plane may sometimes collide with a bill guide. In this case, fold occurs and the cut portion easily slips into a back face side of the tape (reverse side to the bill winding face). Therefore, danger is increased that the bill is cut into two sections at the cut and discharged as described later.

An object of the present invention is to avoid the above-described trouble and to provide a bill receiving and discharging device and a bill handling apparatus with high reliability.

To solve the above problems, a bill receiving and discharging device having a wheel for winding a tape together with a bill and a reel for winding a tape rewound from the wheel according to the present invention is characterized by comprising regulating means, which is disposed along an outer peripheral surface of the wheel, extends from a central portion in a width direction of the tape toward end faces of the tape, and guides end portions of a bill discharged together with the tape unwound from the wheel to an outside of a back side region of the tape.

Further, the bill receiving and discharging device according to the present invention is characterized by comprising discharging means, which is located near a discharge end of the device and is disposed on a reverse side to the bill winding face of the tape and discharges the end portions of the bill advancing onto the reverse side of the tape to the outside of the back side region of the tape.

By the configuration as described above, first, a cut corner portion greatly deformed out of plane from the outer peripheral surface of the wheel can be guided to the outside of the back face region of the tape, and next, and a slip of the cut corner portion into the back face of the tape caused by a fold due to collision with the bill guide can be restrained to the minimum. Furthermore, by completely removing the cut corner portion from the back side region of the tape at a position near the discharge end of the device, it is possible to realize steady discharge of a cut bill.

The regulating means may be supported rotatably on a fixed shaft of guide means that is movable in accordance with change in an outer diameter of the wheel caused by the winding of the tape, and the regulating means itself may be made to be movable in accordance with the change in the outer diameter of the wheel.

The discharging means may be configured so as to be fixed to the guide means or may be configured so as to be movable in accordance with the change in the outer diameter of the wheel.

DESCRIPTION OF THE PREFERRED EMBODIMENTS

Figure 23:
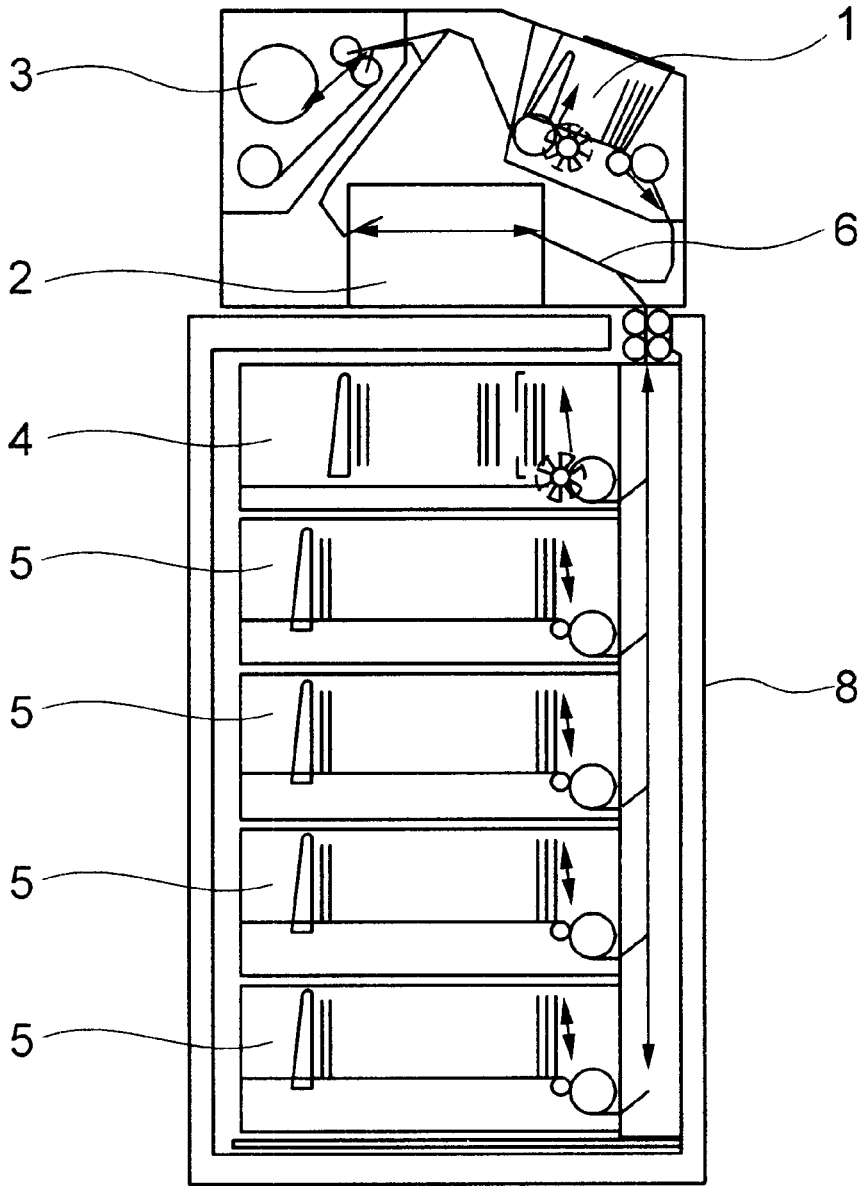
FIG. 23 is a schematic view of a bill handling apparatus on which a bill receiving and discharging device of the present invention is mounted.

First, one embodiment of a bill handling apparatus to which the present invention is applied will be described. FIG. 23 is a sectional view of a portion of a bill handling apparatus 8 to which a bill receiving and discharging device 3 is applied. Here, flow of a bill at a time of paying-in transaction will be explained.

When bills are charged into a paying-in and paying-out port 1 that handles bills of various kinds with different sizes, the bills are separated one by one at the paying-in and paying-out port 1, and are sent to a transfer path 6. The sent bills pass through the transfer path 6, and money kinds are discriminated by a discriminator 2, and thereafter the bills are stored temporarily in the bill receiving and discharging device 3 in a state in which various kinds of bills exist mixedly.

Based on discrimination result of the discriminator 2, an amount of money of the bills collectively charged into the paying-in and paying-out port 1 is notified via a notifying device (not shown) to a person who paid in the money. After the amount of money is confirmed and the paying-in transaction is confirmed, the bills stored in the bill receiving and discharging device 3 in a state in which various kinds exist in mixture are discharged, and pass through the transfer path 6, and are stored in recycling cassettes 5 for storing bills of each kinds or a paying-in a cassette 4 on the basis of the discrimination result of the discriminator 2.

Next, paying-out transaction will be described. The bill handling apparatus 8 separates bills corresponding to a specified amount from the bills stored in the recycling cassettes 5 for each kind. The separated bills pass through the transfer path 6, and the kinds of money are discriminated by the discriminator 2, and thereafter, the bills judged to be normal bills are transferred to the paying-in and paying-out port 1, and are paid out. The bills which have been judged by the discriminator 2 to be improper to paying-out on the basis of transfer conditions, bill conditions, etc. are stored temporarily in the bill receiving and discharging device 3. After the paying-out transaction is concluded, the bills stored in the bill receiving and discharging device 3 are discharged, passing through the transfer path 6, and are stored in the paying-in cassette 4 or the recycling cassettes 5.

As described above, the bill receiving and discharging device 3 to which the present invention is applied is used as a temporary stacker for the bill handling apparatus 8, which temporarily stores bills before the bills are stored in the paying-in cassette 4 or the recycling cassettes 5.

Next, one embodiment of the bill receiving and discharging device to which the present invention is applied will be described.

Figure 1:
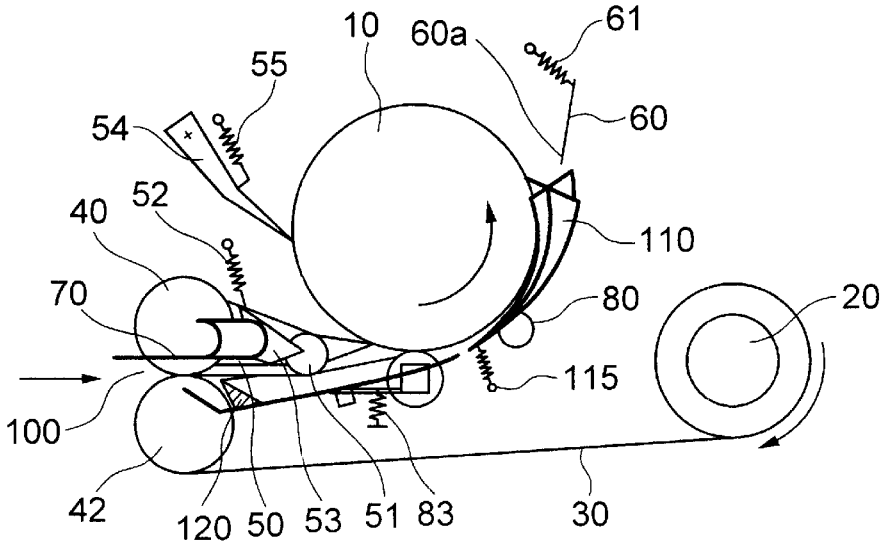
FIG. 1 is a side view of a bill receiving and discharging device in accordance with one embodiment of the present invention (initial state of bill receiving operation)
Figure 2:
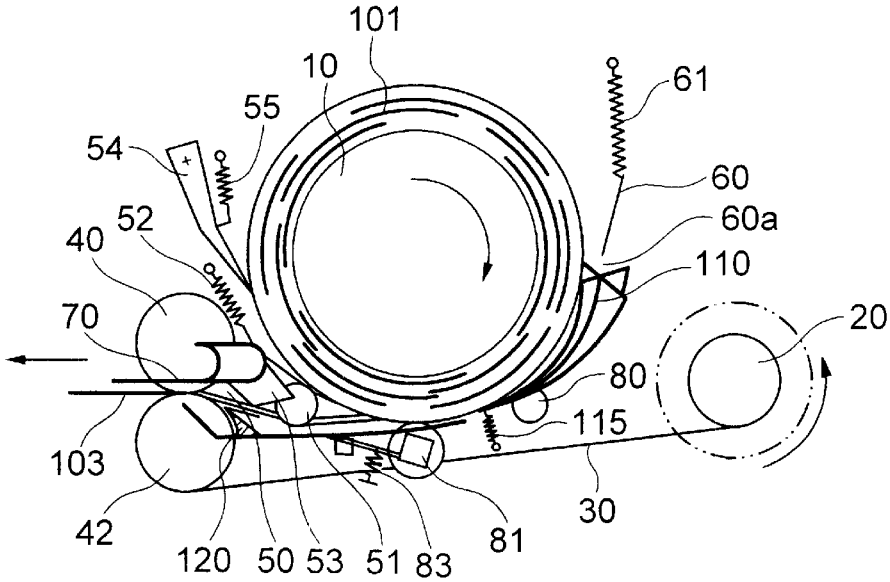
FIG. 2 is a side view of the bill receiving and discharging device in accordance with one embodiment of the present invention (complete state of bill receiving operation)
Figure 3:
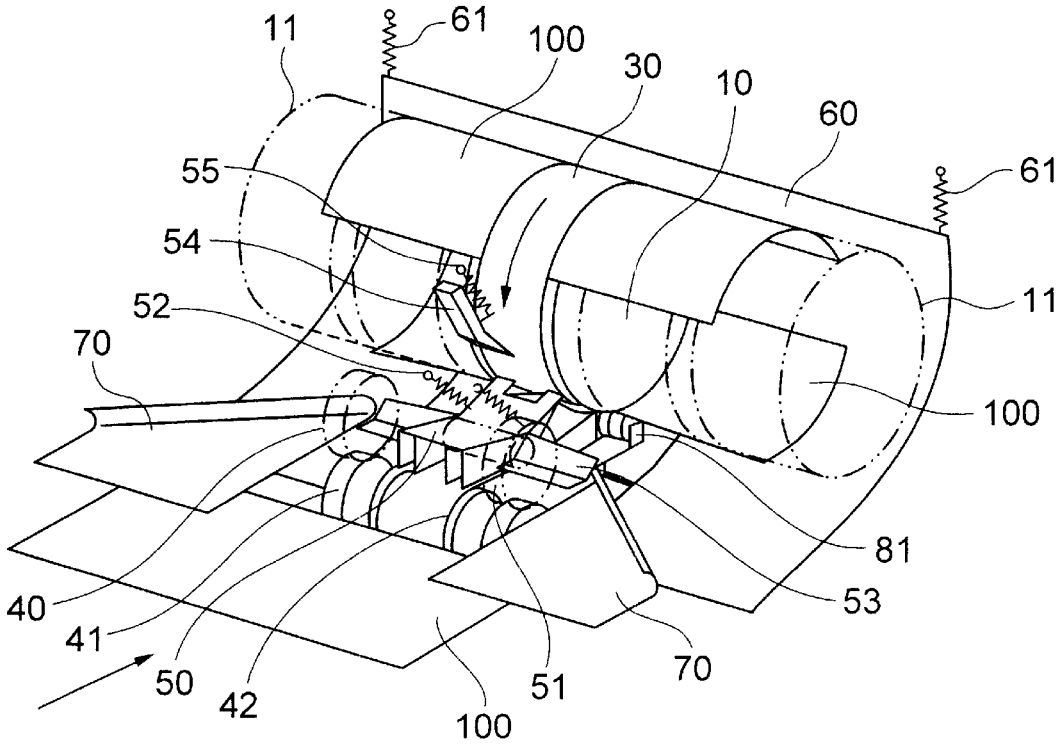
FIG. 3 is a perspective view of the bill receiving and discharging device in accordance with one embodiment of the present invention (initial state of bill receiving operation)
Figure 4:
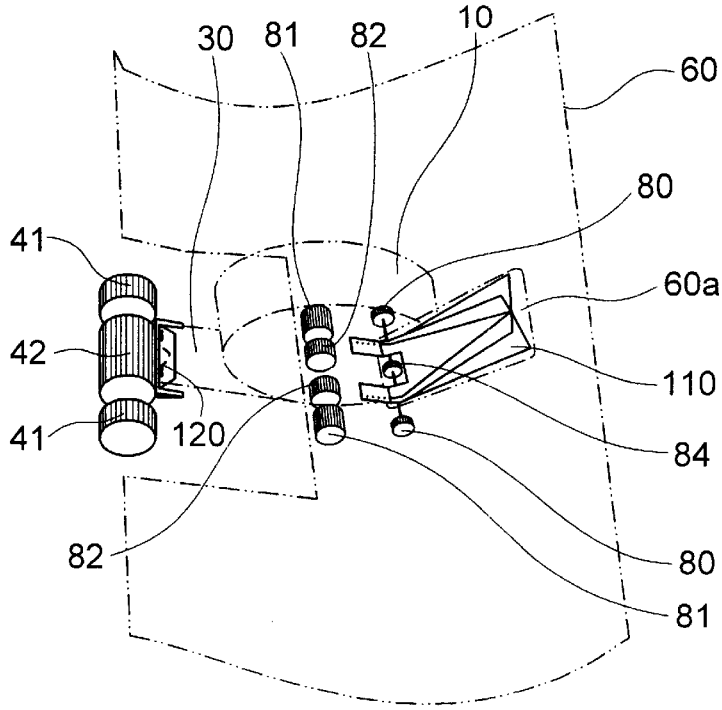
FIG. 4 is a perspective view of a main construction section in accordance with one embodiment of the present invention.

FIG. 1 is a side view showing an entire configuration of the bill receiving and discharging device 3 in accordance with one embodiment of the present invention. FIG. 2 is a side view showing a state in which the bills having been transferred are stored in the bill receiving and discharging device 3. FIG. 3 is a perspective view for illustrating the configuration shown in FIG. 1, and FIG. 4 is a perspective view for illustrating a main construction section of the present invention. The entire configuration of the bill receiving and discharging device 3 in accordance with one embodiment of the present invention will be described with reference to FIGS. 1, 2, 3 and 4.

A reel 20 on which one end of a tape 30 is fixed is driven by a driving source (not shown). The other end of the tape 30 that is fixed to and wound on the reel 20 is fixed to an outer peripheral surface of a wheel 10. The wheel 10 is also driven by a driving source (not shown). On a rotating shaft of the reel 20, a torque limiter, not shown, is disposed. By disposing a motor for rotating the reel 20 via the torque limiter, the tape 30 can be wound or rewound while a tension is always applied to the tape 30 when bills are received or discharged.

The tape 30 having been wound on the reel 20 changes its direction via an outer peripheral surface of an intermediate roller 42, and is wound on the wheel 10. The intermediate roller 42 is rotationally driven by a frictional force with the tape 30 wound around the outer peripheral surface thereof, but rotation thereof is controlled so that winding speed of the tape 30 on the wheel 10 becomes constant. By these mechanisms, a bill 100 having been transferred from the outside of the device 3 can be received by winding it together with the tape 30 on the outer peripheral surface of the wheel 10 around which the tape 30 have been wound.

Regarding the width of the tape 30, the wider the width is, the more steadily bills can be held, and also a distance between the holding portion and edges of the bill decreases, so that the bill edge can be easily prevented from floating. Therefore, it is desirable to set the width of the tape 30 so as to be wider. However, if the width of the tape 30 is set so as to be wider, there is accordingly a disadvantage that an inertial load of the wheel 10 increases when the tape 30 is wound on the wheel 10. Thereupon, the tape 30 having a proper width must be used. As the material for the tape 30, from the viewpoint of inertial load and miniaturization, material is suitable that has high mechanical properties such that the strength is high even if the thickness is thin and that is lightweight.

Also, since the tape 30 performs winding of bills, it is desirable that bills be wound on the wheel 10 together with the tape 30 and be discharged along with the unwinding of the tape 30 at a central portion of the width of the bill transfer path for bill transferring for receiving and discharging.

The rotating shaft of the wheel 10 is provided with auxiliary wheels 11 each having a diameter approximately equal to that of the wheel 10 (indicated by a two-dot chain line in an axial direction of the wheel 10 in FIG. 3). The auxiliary wheels 11 may be provided so as to run idle with respect to the rotating shaft of the wheel 10, or may be fixed to the rotating shaft thereof. By providing the auxiliary wheels 11 so as to run idle, an inertial load of the rotating shaft of the wheel 10 can be decreased to the utmost. Predetermined gaps are provided between the auxiliary wheel 11*s* and the wheel 10, and optical axes from sensors (not shown) for detecting the presence of bill are caused to pass through the gaps. Thereby, the presence of a remaining bill at the time of discharging and the presence of a bill in the initial state before receiving can be confirmed.

Transfer rollers 41 are fixed at sides of the intermediate roller 42 so as to be coaxial with the rotating shaft of the intermediate roller 42. Idle rollers 40 in pressingly contact with the transfer rollers 41 are disposed at positions opposing to the transfer rollers 41 with respect to the bill transfer path. The transfer rollers 41 and the idle rollers 40 are rotationally driven by the rotation of the intermediate roller 42.

A first scraper 50 is pivotally provided around the rotating shaft of the idle rollers 40. First scraper guides 53 are fixed at both sides of the first scraper 50. The first scraper 50 is raised upward by springs 52 for the first scraper so that a tip end thereof comes into contact with the surface of the tape 30 wound on the outer peripheral surface of the wheel 10.

An auxiliary roller 51 running idle is provided rotatably at a substantially intermediate position of the first scraper 50, and is always in contact with the tape 30. The auxiliary roller 51 is rotated by the frictional force with the tape 30.

A second scraper 54 is pivotally provided above the first scraper 50 around an arbitrary fulcrum. A tip end of the second scraper 54 is always raised by a spring 55 for the second scraper so as to come into contact with the surface of the tape 30 wound on the outer peripheral surface of the wheel 10.

A bill guide 60 is pivotally provided around the rotating shaft of the transfer rollers 41 in this embodiment. The bill guide 60 is a guide for smoothly guiding a bill along the outer peripheral surface of the wheel 10 when the bill is received. A part of the shape of the bill guide 60 is formed by an arc with a radius larger than a maximum radius of the state in which the maximum number of bills 101 are stored on the outer peripheral surface of the wheel 10 as shown in FIG. 2. The bill guide 60 is raised upward by springs 61 for the bill guide.

Positioning rollers 80 are fixed to the bill guide 60 near both sides of the tape 30 so as to run idle. The positioning rollers 80 come into contact with the outer peripheral surfaces of the auxiliary wheels 11 or the surface of the bill 101 stored by being wound on the wheel 10 together with the tape 30 as shown in FIG. 2, and thereby perform positioning of the bill guide 60.

An auxiliary positioning roller 84 having a diameter smaller than that of the positioning roller 80 may be provided at a position opposing to the tape 30 and on the rotating shaft of the positioning roller 80 so as to run idle. The auxiliary positioning roller 84 is configured so that in the case where bills are received continuously, when a height difference between the surface of the tape 30 wound on the outer peripheral surface of the wheel 10 and the surface of the bill 101 wound on the outer peripheral surface of the wheel 10 is smaller than a predetermined value, the position of the bill guide 60 is determined by the positioning rollers 80, and the auxiliary positioning roller 84 does not come into contact with the outer peripheral surface of the tape 30. However, in the state in which only the tape 30 is wound on the outer peripheral surface of the wheel 10, or when a height difference between the surface of the tape 30 wound on the outer peripheral surface of the wheel 10 on which the bills 101 are stored intermittently and the outermost peripheral surface of the bill 101 stored on the outer peripheral surface of the wheel 10 is larger than a predetermined value, the auxiliary positioning roller 84 comes into contact with the surface of the tape 30 wound on the outer peripheral surface of the wheel 10, and thereby performs positioning of the bill guide 60.

The reason for configuring the auxiliary positioning roller 84 as described above is that because the auxiliary positioning roller 84 in contact with the surface of the tape 30 serves as a friction member and thus has an influence on the service life of the tape 30, the bill guide 60 is positioned by the positioning rollers 80, and the auxiliary positioning roller 84 is prevented from coming into contact with the tape 30 to the utmost when bills are continuously received or discharged in an ordinary manner.

Deformation rollers 81 are provided for idle running near both sides of the tape 30 and in the vicinity of a contact point at which the tape 30 wound on the outer peripheral surface of the wheel 10 goes toward the intermediate roller 42. In this embodiment, the deformation rollers 81 are held by a frame pivotally supported by the bill guide 60, and are raised toward the wheel 10 by a spring 83 for the deformation rollers. This deformation rollers 81 have a shape of two-stage rollers with a different diameter or a tapered shape such that the diameter decreases from the center toward the outside. The deformation rollers 81 are configured so that the center sides of the raised deformation rollers 81 having a larger diameter enter into intermediate grooves between the wheel 10 and the auxiliary wheels 11, and the outer sides of the deformation rollers 81 having a smaller diameter come into contact with the outer peripheral surfaces of the auxiliary wheels 11 in a state in which bills are not wound around the wheel 10. Also, on the shaft of the deformation rollers 81, limitation rollers 82 having a diameter smaller than that of the deformation rollers 81 are provided for idle running at a position opposing to the tape 30 in the center.

The following is a description of a speed control method of the bill receiving and discharging device 8. The transfer speed of the tape 30 is determined by the rotational speed of the rotating shaft of the wheel 10 and the outer diameter of the wheel 10. In order to make the transfer speed of the tape 30 constant, it is necessary to detect a change in the outer diameter of the wheel 10 and to thereby control the rotational speed of the rotating shaft of the wheel 10. However, since the outer diameter of the wheel 10 is changed by the sizes and conditions of stored bills, it is difficult to predict the outer diameter of the wheel 10 based on the number of bills to be stored, and mechanical detection of the outer diameter of the wheel 10 increases the cost.

Therefore, as a method for controlling the transfer speed of the tape 30 so as to be a predetermined value or lower, the rotational speed of the wheel 10 is controlled by utilizing a change in the number of rotations and the rotational speed of the reel 20. Since the reel 20 winds only the tape 30, length of the tape 20 unwound toward the wheel 10 can be calculated from the number of rotations of the rotating shaft of the reel 20 and the thickness of the tape 30. Therefore, the number of rotations of the reel 20 from the initial position and the time taken for the predetermined rotations are detected by sensors, by which the diameter of the reel 20 is predicted. From the time taken for the predetermined number of rotations and the length of unwound tape obtained by the prediction, the tape transfer speed can be calculated. By controlling the rotational speed of the rotating shaft of the wheel 10 on the basis of the calculated transfer speed, the transfer speed of the tape 30 can be controlled in the predetermined value or lower.

The following is a description of a bill receiving operation. When the bill 100 is transferred from the outside of the device 3 into the device 3 as indicated by an arrow in FIG. 1, the wheel 10 is rotationally driven in the counterclockwise direction, that is, in the direction such that the tape 30 is wound on the wheel 10, and the tape 30 having been wound around the reel 20 is wound on the wheel 10.

The bill 100 having transferred from the outside of the bill receiving and discharging device 3 is transferred toward the wheel 10 while being held between the transfer rollers 41 and the idle rollers 40, and then is wound on the outer peripheral surface of the wheel 10 together with the tape 30 while being held between the auxiliary roller 51 provided on the side of the tape 30 of the first scraper 50 and the tape 30, thus being stored in the device 3. When the bill 100 is received, the bill 100 is guided smoothly along the outer peripheral surface of the wheel 10 by the bill guide 60.

By the above-described operation, the bills 100 having been transferred from the outside of the device 3 are wound successively on the outer peripheral surface of the wheel 10 together with the tape 30 to be received, whereby the bill receiving and discharging device 3 can receive a large number of bills 101 as shown in FIG. 2. Also, by receiving the bills 101, the outer diameter of the wheel 10 is increased, so that the first scraper 50, the second scraper 54, the bill guide 60, the deformation rollers 81, and the limitation rollers 82 are pivoted accordingly.

The following is a description of a bill discharging operation. The rotating shaft of the reel 20 is rotationally driven in the counterclockwise direction in FIG. 2, that is, in the direction such that the tape 30 is wound on the reel 20, and thus the tape 30 having been wound on the outer peripheral surface of the wheel 10 together with the bills 101 is rewound on the reel 20, by which the bills 101 are discharged in the arrow direction.

When the bills 101 are discharged, a forward end portion in the discharge direction of a bill 103 to be discharged is deformed into a wavy shape by the right and left deformation rollers 81, by which the bill 103 to be discharged is separated from the outer peripheral surface of the wheel 10. The bill 103 is transferred in the discharge direction in a state of being deformed into a wavy shape. First, the bill 103 to be discharged is transferred onto a bill transfer under-face of the first scraper 50. Then, the bill 103 to be discharges passes through a holding point between the auxiliary roller 51 and the tape 30, and is guided to under-faces of the scraper guides 53 and the guides 70 for discharge bill so as to be discharged to the outside of the device 3 in the direction of an arrow shown in FIG. 2 by the idle rollers 40 in pressingly contact with the transfer rollers 41.

Next, constituent elements of this embodiment will be described in detail.

Figure 5:
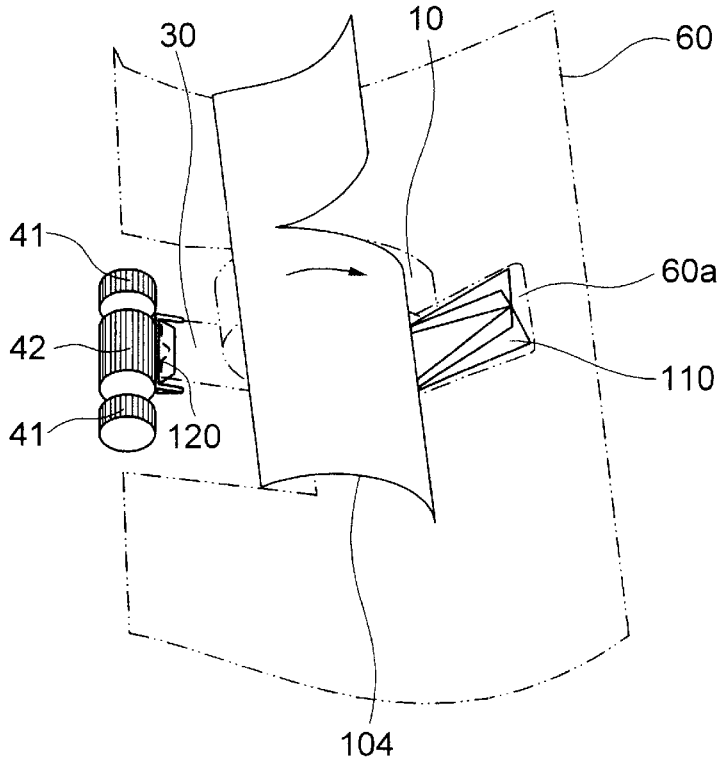
FIG. 5 is a perspective view when a cut bill is discharged.
Figure 6:
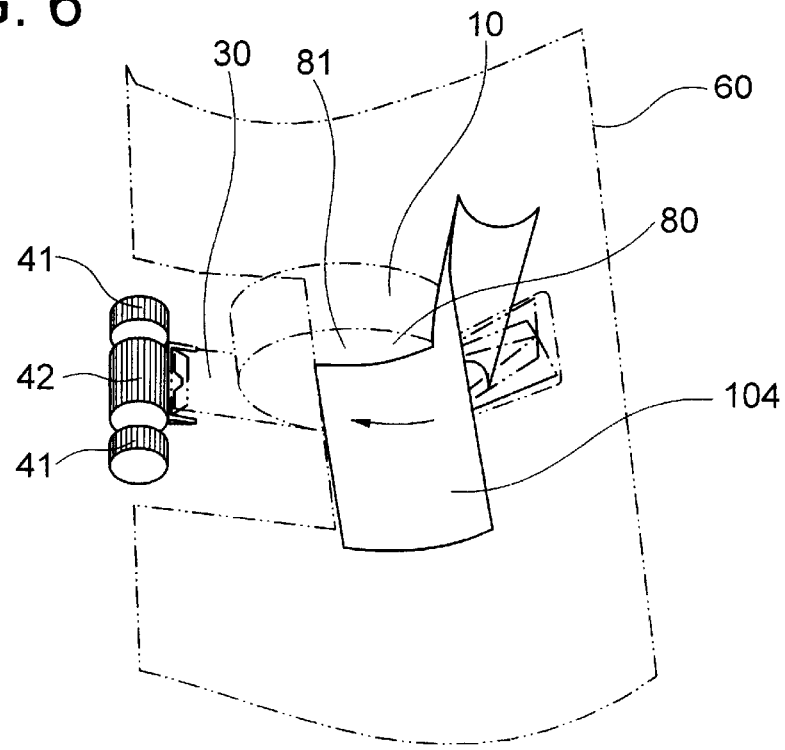
FIG. 6 is a perspective view for illustrating a trouble caused when a cut bill is discharged.
Figure 7:
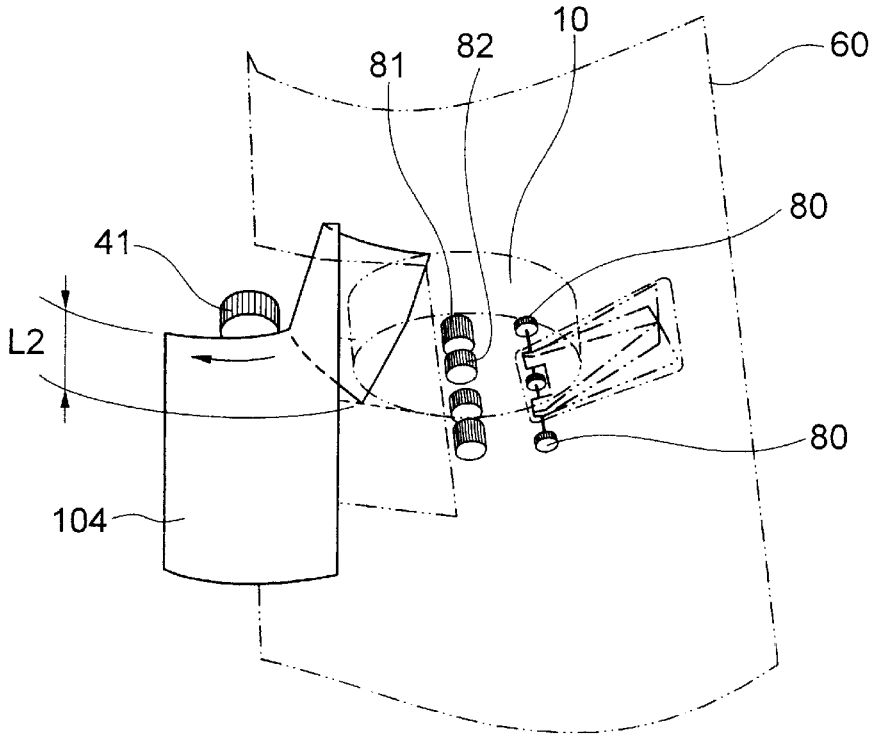
FIG. 7 is a perspective view for illustrating a trouble caused when a cut bill is discharged.
Figure 8:
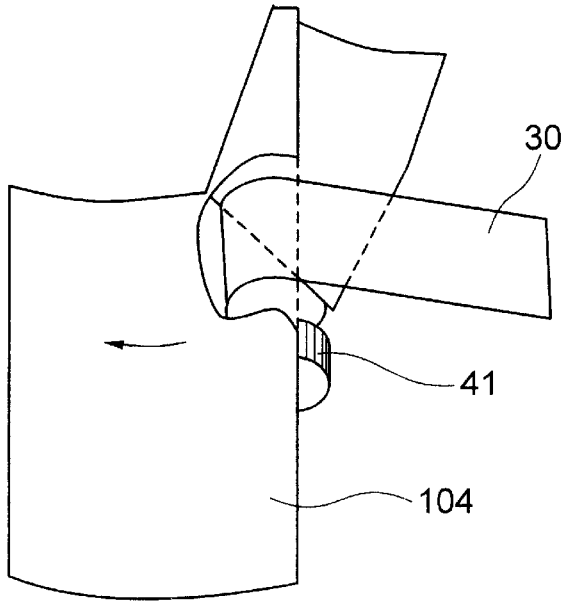
FIG. 8 is a perspective view for illustrating a trouble caused when a cut bill is discharged.

First, the configurations of regulating means 110 and discharging means 120 will be described. A trouble caused when the regulating means 110 and the discharging means 120 are not disposed will be described with reference to FIGS. 5 to 8. As shown in FIG. 5, in the case where a cut portion exists at a leading edge of a bill 104 to be discharged and on an outside of tape edge, a cut corner portion cannot be held by the tape 30, so that it is subjected to great out-of-plane deformation from the outer peripheral surface of the wheel 10. In this case, if the regulating means 110 and the discharging means 120 are not disposed, a fold occurs at the cut corner portion by collision with the bill guide 60, so that the cut corner portion slips into the back side of bill transfer face of the tape 30 (FIG. 6). When the bill discharging operation from the wheel 10 proceeds, an amount of slip of the cut corner portion into the back side of the tape 30 increases to L2 (FIG. 7). If the bill is discharged in this state, the cut corner portion is caught between the tape 30 and the intermediate roller 42, and the remaining portion of cut bill is discharged by the transfer roller 41, so that a serious trouble such that the cut bill is cut into two sections occurs (FIG. 8).

Thereupon, to avoid the above-described trouble, in this embodiment, the regulating means 110 and the discharging means 120 are provided. First, the regulating means 110 will be described.

Figure 9:
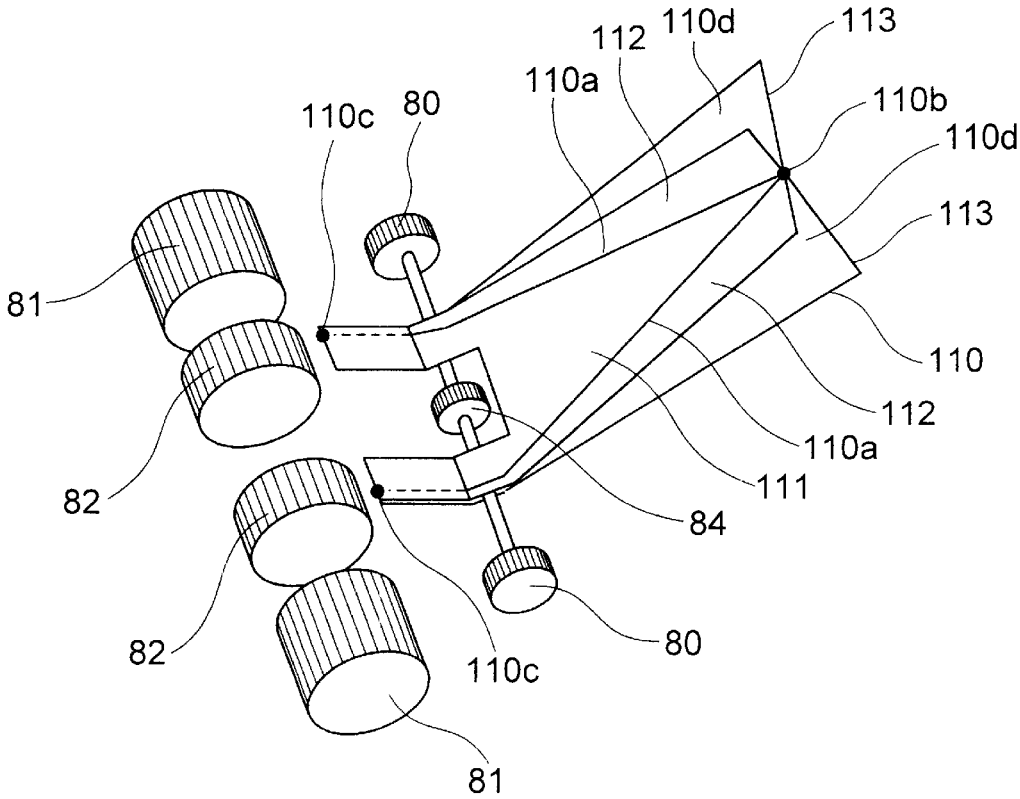
FIG. 9 is a perspective view of regulating means 110.

FIG. 9 is a perspective view showing a construction of the regulating means 110. The regulating means 110 includes a base plate 111 of a substantially planar shape, which is located on the outside of the wheel 10 and is disposed along the outer peripheral surface of the wheel 10, upper-face wings 112 disposed so as to be inclined toward the wheel 10 from side edges of the base plate 111, and lower-face wings 113 disposed so as to be inclined apart from the wheel 10 from the side edges of the base plate 111.

The width of the base plate 111 increases toward downstream side in the direction of rotation of the wheel 10 at the time of bill discharge. The widths of the upper-face wings 112 and the lower-face wings 113 are formed to decrease accordingly.

The regulating means 110 of this embodiment is supported rotatably on the shaft of the positioning rollers 80 so as to be movable in accordance with a change in the outer diameter of the wheel 10. In order to enable the configuration of the regulating means 110, an opening 60*a* is formed in the bill guide 60 in this embodiment (FIG. 4).

Also, as shown in FIGS. 1 and 2, the regulating means 110 is configured so as to be always in contact with the outer diameter of the wheel 10 by the action of a tension spring 115.

The cut corner portion that is going to slip into the back side of the tape 30 is guided into a space 110*a* formed by the upper-face wing 112 and the lower-face wing 113. At this time, if the width of the lower-face wing 113 is made greater than the width of the upper-face wing 112, it becomes easily to guide the cut corner portion into the space 110*a*. A guide member may be provided separately to guide the cut corner portion into the space 110*a*.

Subsequently, the cut corner portion is regulated along a line of intersection of the upper-face wing 112 and the lower-face wing 113, that is, a path connecting points 110*b* and 110*c*, and is guided to the outside of the back side region of the tape 30.

By structuring the width of the base plate 111 so as to increase toward the downstream side in the direction of rotation of the wheel 10 at the time of bill discharge, the path connecting the points 110*b* and 110*c* can effectively guide the cut corner portion from the back side region of the tape 30 to the outside.

Figure 10:
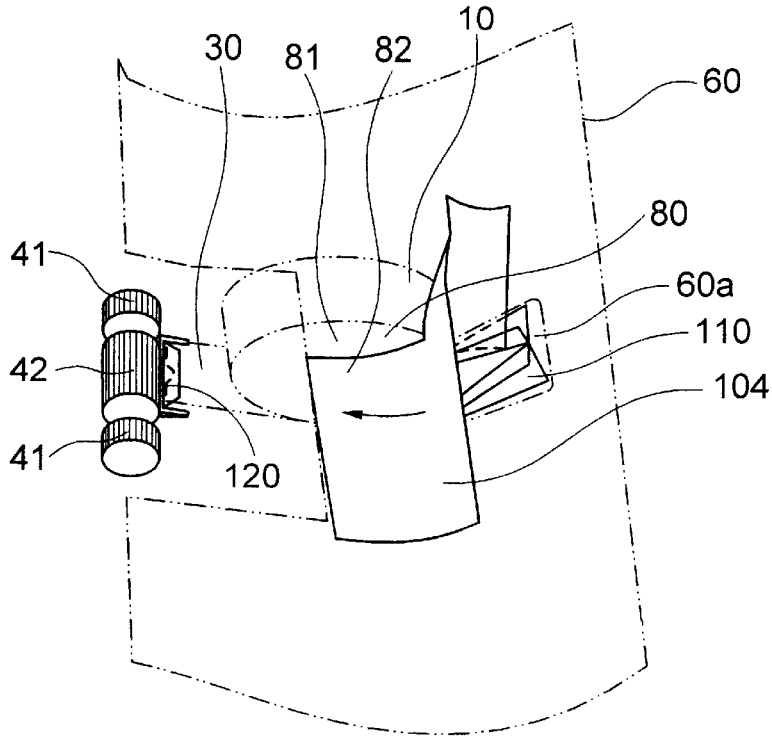
FIG. 10 is a perspective view for illustrating the operation of the regulating means when a cut bill is discharged.
Figure 11:
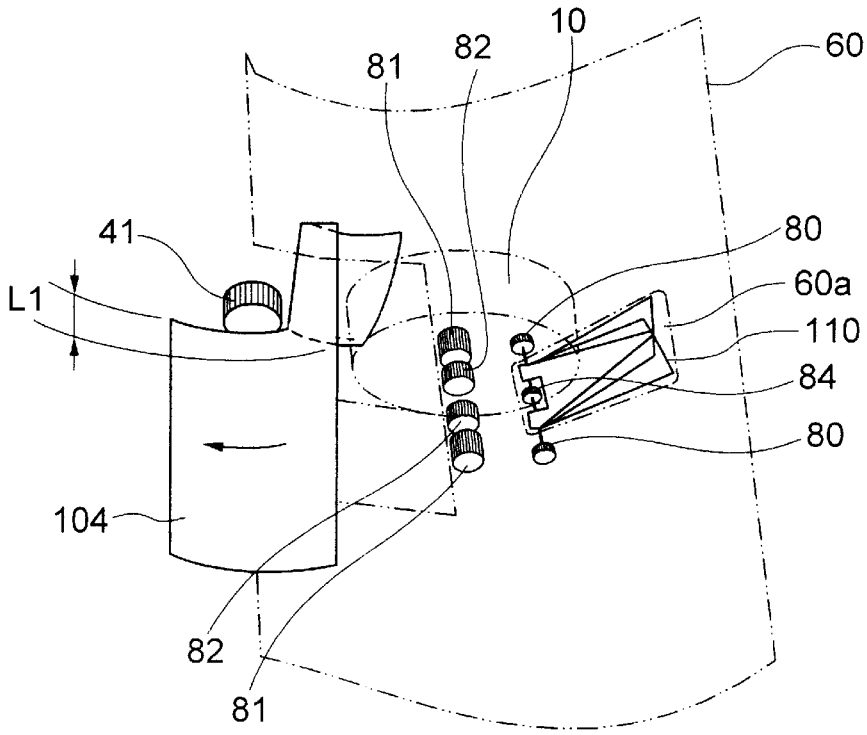
FIG. 11 is a perspective view for illustrating a state at a time when a cut bill is discharged.

FIG. 10 is a perspective view for illustrating this situation. Also, FIG. 11 shows a state in which an amount of slip of the cut corner portion into the back face of the tape 30 is restraint into a small value L1, by action of the regulating means 110.

Next, the discharging means 120 will be described. The discharging means 120 is disposed at a position at which the tape 30 is wound on the intermediate roller 42, that is, at a position near a discharge end of the bill receiving and discharging device and on the side opposite to the tape face on which bills are wound. The discharging means 120 is provided to prevent the cut corner portion from slipping in between the tape 30 and the intermediate roller 42.

Figure 12:
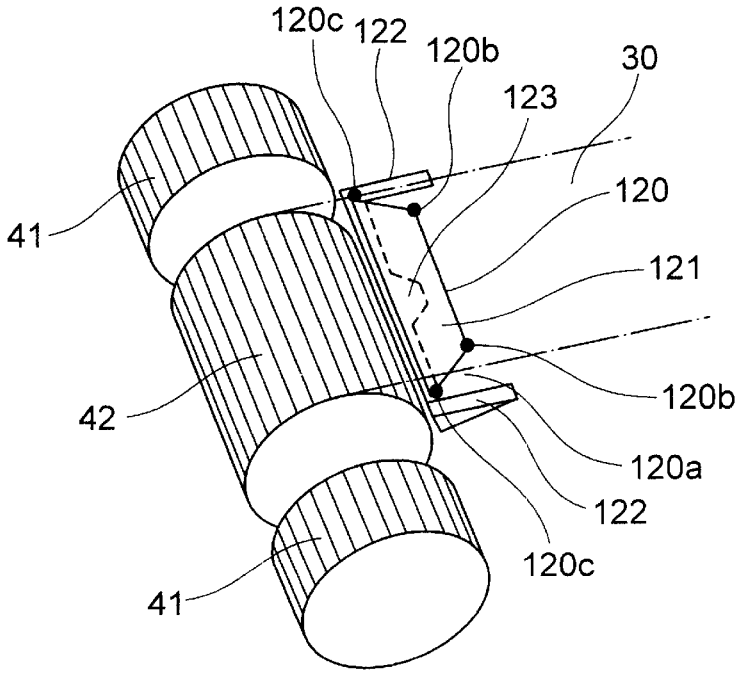
FIG. 12 is a perspective view of discharging means 120.
Figure 13:
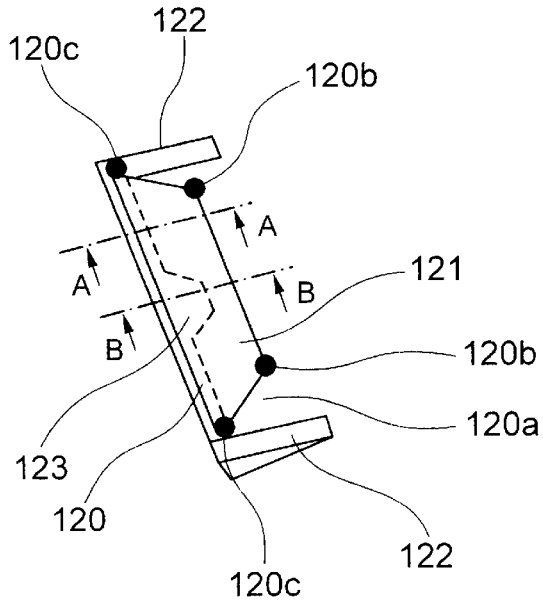
FIG. 13 is a perspective view of the discharging means 120.

The discharging means 120 of this embodiment has a shape as shown in FIGS. 12 and 13. This means 120 is disposed near the bill discharge end of the device 3, that is, near the intermediate roller 42 and on the back face side of the tape 30. The discharging means 120 may be fixed on a wall surface of the bill guide 60, or may be configured so as to be movable in accordance with a change in the outer diameter of the wheel 10 as described later.

Figure 14:
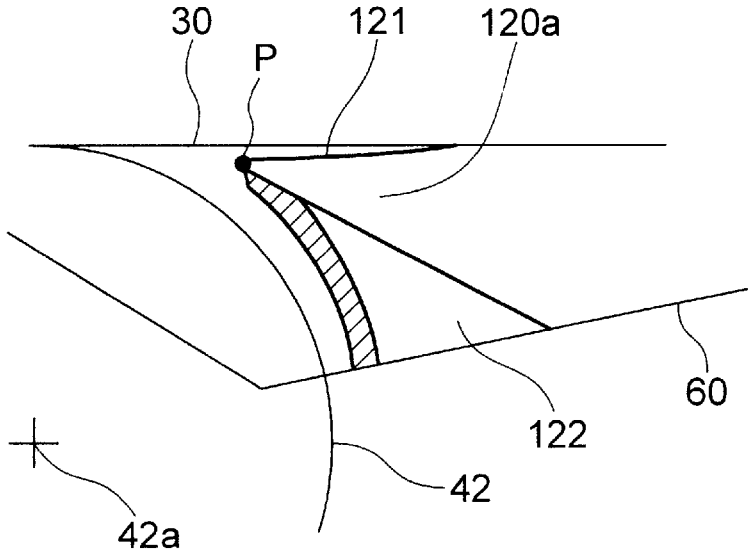
FIG. 14 is a sectional view of the discharging means 120, taken along a line A—A in FIG. 13.
Figure 15:
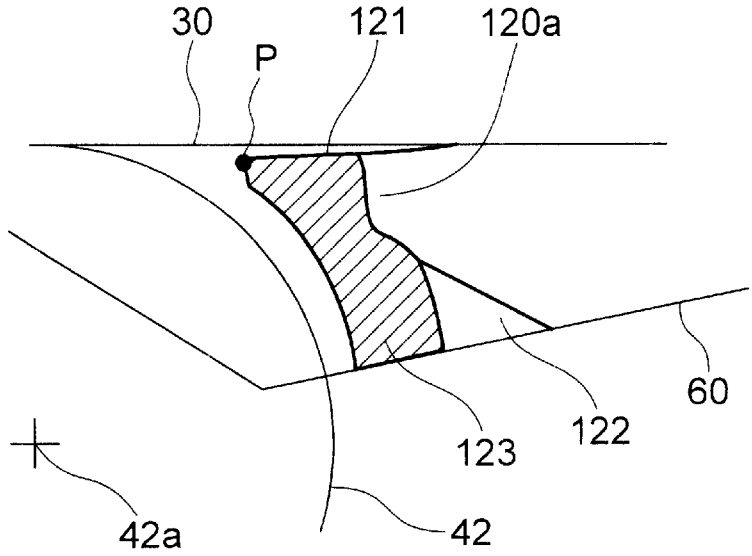
FIG. 15 is a sectional view of the discharging means 120, taken along a line B—B in FIG. 13.

The discharging means 120 is mainly made up of a base plate 122 of a substantially triangular shape in cross section and a sheet-form thin element 121 extending toward the tape 30 from a corner portion (point P in FIGS. 14 and 15) on the tape side of the base plate 122, and a receiving space 120*a* for receiving the cut corner portion that is going to slip into the back face of the tape 30 is formed (FIG. 14). Also, a protruding member 123 may be disposed in a central portion in the receiving space 120*a* (FIG. 15). FIG. 14 is a sectional view taken along line A—A in FIG. 13, and FIG. 15 is a sectional view taken along line B—B in FIG. 13. A hatched portion in FIG. 15 is the protruding member 123. The protruding member 123 is provided to facilitate the discharge of the cut corner portion by giving rotational moment to the cut corner portion when the cut corner portion advancing into the receiving space 120*a* comes into contact with a tip end portion of the protruding member 123.

Figure 16:
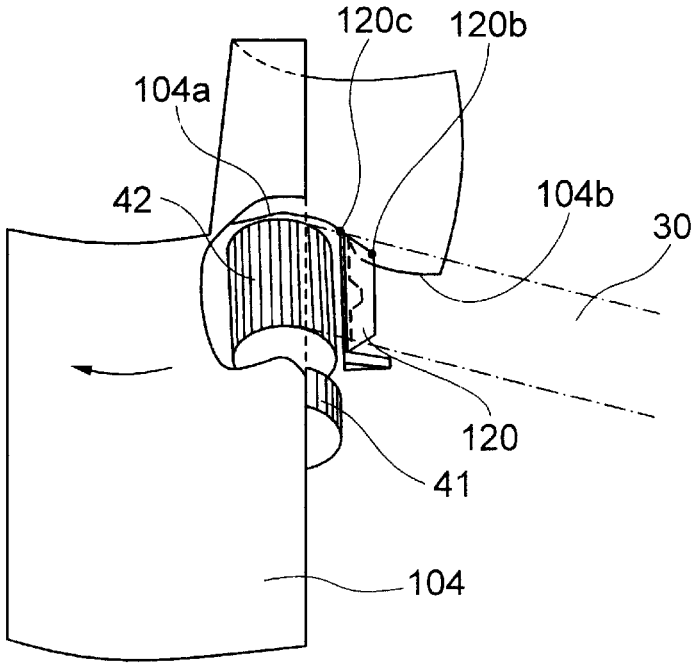
FIG. 16 is a perspective view for illustrating the operation of the discharging means when a cut bill is discharged.
Figure 17:
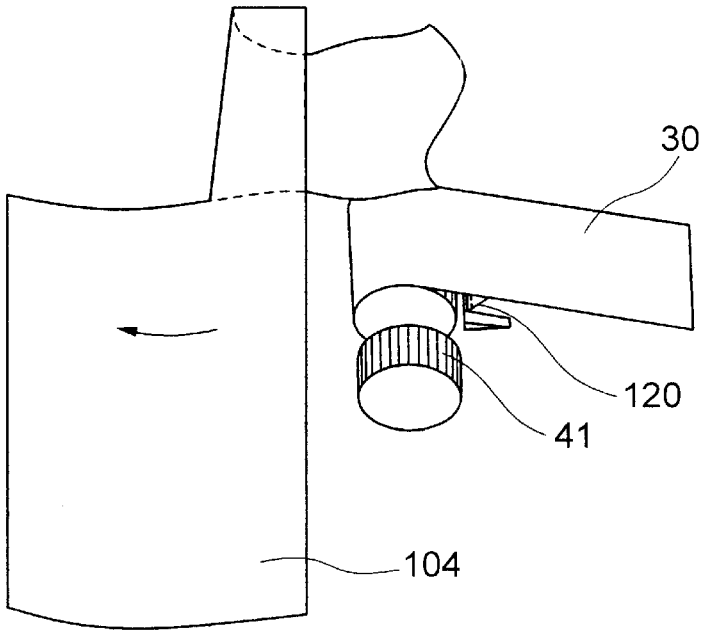
FIG. 17 is a perspective view for illustrating a state at a time when a cut bill is discharged.

The cut corner portion having advanced into the receiving space 120*a* is pulled out from a point 120*c* of the discharging means 120 shown in FIG. 12 while being guided by a wall portion in the receiving space 120*a* as shown in FIG. 16, and finally discharged to the outside of the back side region of the tape 30 as shown in FIG. 17.

The discharging means 120 can more effectively guide the cut corner portion from the back side region of the tape 30 to the outside by being disposed at a position as close to the intermediate roller 42 as possible. In this embodiment, therefore, as shown in FIGS. 14 and 15, one side of the base plate 122 of a triangular shape in cross section of the discharging means 120 has an arcuate shape following the outer periphery of the intermediate roller 42, and is positioned as close to the intermediate roller 42 as possible.

Next, another configuration of the discharging means will be described with reference to FIGS. 18 to 21.

Figure 18:
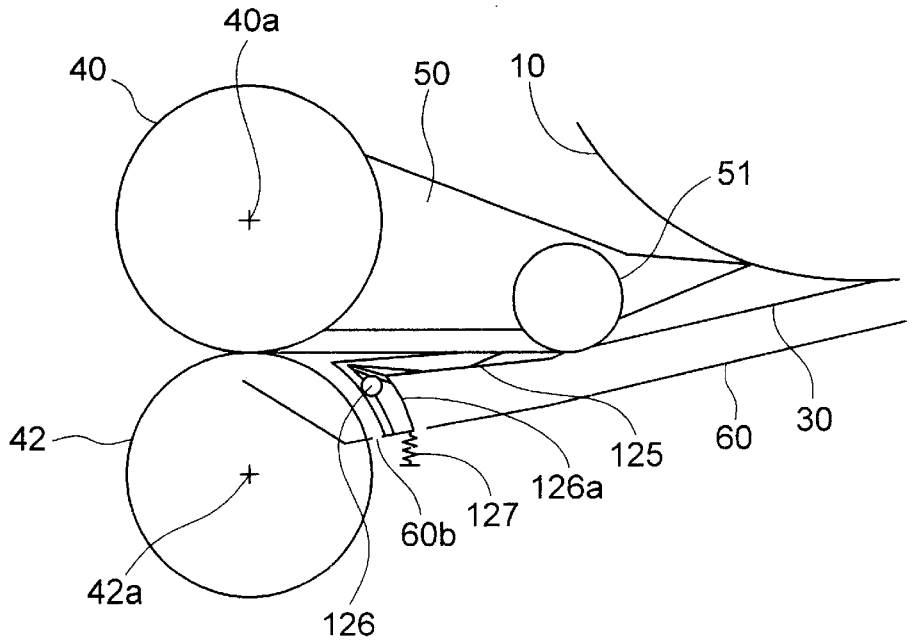
FIG. 18 is a sectional view of a discharge guide 125 (initial state of bill receiving operation)
Figure 19:
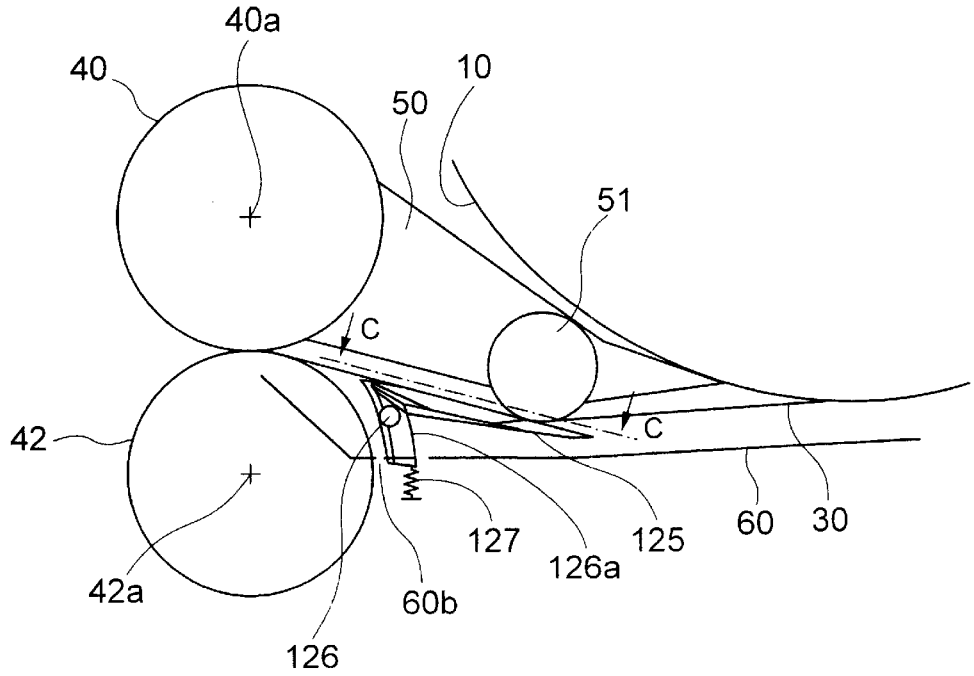
FIG. 19 is a sectional view of the discharge guide 125 (complete state of bill receiving operation)
Figure 20:
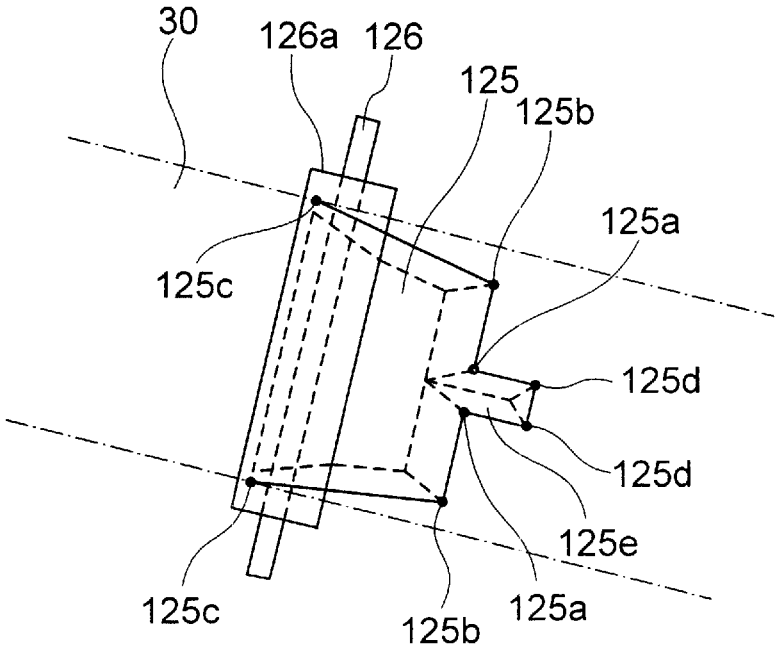
FIG. 20 is a perspective view of the discharge guide 125.

FIG. 18 shows another configuration of the discharging means. A discharge guide 125 shown in FIG. 18 has a shape as shown in FIG. 20 (a view viewed from line C—C in FIG. 19), and a base member 126*a* is fixed on a shaft 126 passing through the base member 126*a*. The shaft 126 is supported for rotation through a bracket (not shown) on the bill guide 60. Therefore, the discharge guide 125 can turn around the shaft 126.

The discharge guide 125 is provided near an end of the base member 126*a* at the side of the tape 30. The other end of the discharge guide 125 is in contact with the back face of the tape 30.

A compression spring 127 is disposed at a lower end of the base member 126*a*, so that a moment acts on the discharge guide 125 in the counterclockwise direction around the shaft 126, that is, in such a manner that a distal end of the discharge guide 125 comes into contact with the back face of the tape 30. In order to realize such a configuration, the bill guide 60 of this embodiment is formed with a through hole 60*b*.

The sides (125*d*-125*a*-125*b*-125*c*) of the discharge guide 125 for receiving the cut corner portion are chamfered into a slope shape to minimize the thicknesses of the contours of the sides. By providing this chamfered discharge guide 125, the collision of the cut corner portion with the discharge guide 125 can be avoided, so that the cut corner portion can be guided more effectively as described later.

A distal end (side 125*d*—125*d* shown in FIG. 20) of the movable discharge guide 125 is in contact with the lower end portion of the auxiliary roller 51 through the tape 30 in a state in which the outer diameter of the wheel 10 is the minimum as shown in FIG. 18. On the other hand, as the number of bills received by the wheel 10 increases, the first scraper 50 turns clockwise around an axis 40*a* of the idle rollers 40, so that a state shown in FIG. 19 is established when the largest number of bills are received. In response to this change in outer shape of the wheel 10, the fixed shaft 126 of the discharge guide 125 turns clockwise around an axis 42*a* of the intermediate roller 42 together with the bill guide 60.

The discharge guide 125 itself is turned counterclockwise around the fixed shaft 126 by the action of the compression spring 127. Thereby, the contact point with the lower end portion of the auxiliary roller 51 through the tape 30 is moved gradually in the direction far away from the distal end of the discharge guide 125. In this embodiment, it is designed so that the aforementioned contact point in the state shown in FIG. 19 comes on the side 125*a*-125*b* in FIG. 20.

As described above, by the movable configuration, contact between the discharge guide 125 and the back face of the tape 30 can be kept. Therefore, a phenomenon that the cut corner portion passes through a minute space produced between the back face of the tape 30 and the upper face of the discharge guide 125, that is a slip-put phenomenon of the cur corner portion can be prevented, so that the cut corner portion can be discharged more securely from the back face region of the tape 30.

Figure 21:
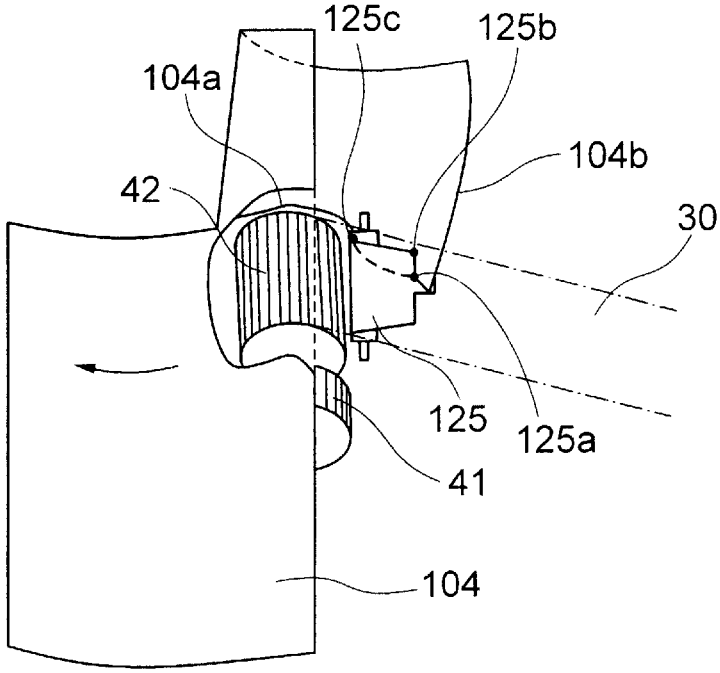
FIG. 21 is a perspective view for illustrating the operation of the discharging means when a cut bill is discharged.

FIG. 21 is a perspective view for illustrating the operation of the discharge guide 125 in the case where the outer diameter of the wheel 10 is the maximum (FIG. 19) and the cut corner portion has slipped greatly into the back face of the tape 30.

As described above, because the side 125*a*-125*b* of the discharge guide 125 and the lower end portion of the auxiliary roller 51 are in contact with each other through the tape 30, a cut corner portion 104*b* on the back face of the tape 30 is received from the side 125*a*-125*b* into a receiving space formed by the lower face of the discharge guide 125 and the base member 126*a*. The cut corner portion 104*b* coming into the receiving space is pulled out from a point 125*c*, and is discharged to a cut corner portion 104*a* outside the back side region of the tape 30 as shown in FIG. 21.

Figure 22:
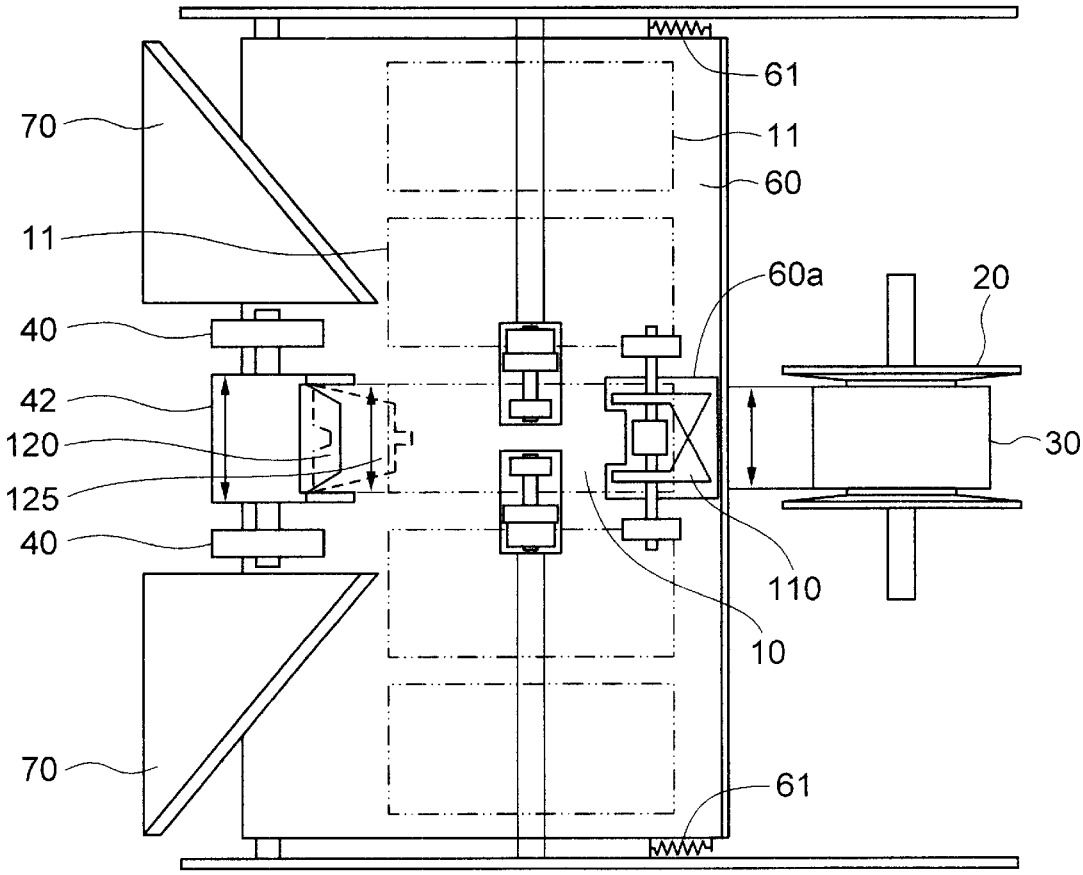
FIG. 22 is a plan view of a bill receiving and discharging device in accordance with one embodiment of the present invention.

FIG. 22 is a plan view of the bill receiving and discharging device 3 in accordance with one embodiment of the present invention. The regulating means 110 is provided so that the width thereof is approximately equal to that of the tape 30. If the width of the regulating means 110 is set so as to be greater than the width of the tape 30, the cut corner portion can be removed more securely from the back side region of the tape 30, but a trouble as described below may occur.

A bill held by the tape 30 is held in the range of width of the tape 30. A portion of bill that is not held by the tape 30 floats slightly from the outer peripheral surface of the wheel 10, so that there is a fear that the floating portion may collide with the regulating means 110 that is wider than the tape 30.

In this embodiment, considering zigzag motion of the tape 30, the width of the regulating means 110 has been set so as to be slightly narrower than the width of the tape 30.

The total width of the discharging means 120 (or 125) is set so as to be approximately equal to the width of the intermediate roller 42 that is wider than the tape 30. Also, distance between the points 120*c* and 120*c* of the discharging means 120 and distance between the points 125*c* and 125*c* of the discharging means 125 are set so as to be approximately equal to the width of the tape 30.

By the configuration as described above, the cut corner portion of bill can be removed more securely from the back side region of the tape 30.

As described above, in this embodiment, by the operation and effect of the regulating means 110 and the discharging means 120 (or 125), a serious trouble such that a cut bill is cut into two sections can be eliminated. Therefore, according to the present invention, there can be provided a bill receiving and discharging device capable of steadily receiving and discharging a bill of bad condition such as a cut bill, and further a bill handling apparatus provided with this bill receiving and discharging device.

Although a device provided with both of the regulating means 110 and the discharging means 120 (or 125) has been shown in this embodiment, both means are not necessarily needed, and the effect of one means can be achieved singly.

However, the provision of both of the regulating means and the discharging means can realize a steady discharging operation more effectively.

As described above, according to the present invention, a bill receiving and discharging device and bill handling apparatus with high reliability can be provided.

What is claimed is:

1. A bill receiving and discharging device having a wheel for winding a tape together with a bill and a reel for winding the tape rewound from said wheel, including a regulating device comprising a base plate disposed along an outer peripheral surface of said wheel, upper-face wings disposed so as to be inclined in a direction from side edges of said base plate toward said wheel, and lower-face wings disposed so as to be inclined in a direction from the side edges of said base plate apart from said wheel, said base plate having width increasing toward downstream side in a direction of rotation of said wheel at a time of bill discharge, and said upper-face wings and said lower-face wings having widths decreasing as the width of said base plate increases.

2. A bill receiving and discharging device having a wheel for winding a tape together with a bill and a reel for winding the tape rewound from said wheel, including a discharging device located near a discharge end of said device, disposed on a side opposite to a bill winding face of said tape, and including a base plate of a substantially triangular shape in cross section and a sheet-form thin element extending from a corner portion on a tape side of said base plate toward said tape.

3. A bill receiving and discharging device having a wheel for winding a tape together with a bill and a reel for winding the tape rewound from said wheel, including a regulating device, which is disposed along an outer peripheral surface of said wheel, extends from a central portion in a width direction of said tape toward end faces of said tape, and guides end portions of a bill discharged together with said tape rewound from said wheel to an outside of a back side region of said tape.

4. A bill receiving and discharging device having a wheel for winding a tape together with a bill and a reel for winding the tape rewound from said wheel, comprising a discharging device, which is located near a discharge end of said device, is disposed on a side opposite to a bill winding face of said tape, and discharges an end portion of the bill advancing onto the opposite side of said tape to an outside of a back side region of said tape.

5. The bill receiving and discharging device according to claim 1 or 3, wherein said regulating device is movable in accordance with a change in an outer diameter of said wheel caused by winding said tape.

6. The bill receiving and discharging device according to claim 2 or 4, wherein said discharging device is movable in accordance with a change in an outer diameter of said wheel caused by winding said tape.

7. A bill handling apparatus having: a bill handling port for paying-in and paying-out of a bill; a transfer path for transferring the bill in a direction of a short side of the bill with respect to said bill handling port; a discriminator for discriminating the bill transferred through said transfer path; a storage cassette, which is connected to said transfer path, for storing the bill so as to be capable of paying out the bill; and a bill receiving and discharging device for temporarily storing the bill discriminated by said discriminator, wherein said bill receiving and discharging device comprises:

a wheel for winding a tape together with the bill;

a reel for winding the tape rewound from said wheel; and a regulating device having a base plate disposed along an outer peripheral surface of said wheel, upper-face wings disposed so as to be inclined in a direction from side edges of said base plate toward said wheel, and lower-face wings disposed so as to be inclined in a direction from the side edges of said base plate apart from said wheel, said base plate having width increasing toward downstream side in a direction of rotation of said wheel at a time of bill discharge, and said upper-face wings and said lower-face wings having widths decreasing as the width of said base plate increases.

8. A bill handling apparatus having: a bill handling port for paying-in and paying-out of a bill; a transfer path for transferring the bill in a direction of a short side of the bill with respect to said bill handling port; a discriminator for discriminating the bill transferred through said transfer path; a storage cassette, which is connected to said transfer path, for storing the bill so as to be capable of paying out the bill; and a bill receiving and discharging device for temporarily storing the bill discriminated by said discriminator, wherein said bill receiving and discharging device comprises:

a wheel for winding a tape together with the bill;

a reel for winding the tape rewound from said wheel; and a discharging device located near a discharge end of said device, disposed on a side opposite to a bill winding face of said tape, and including a base plate of a substantially triangular shape in cross section and a sheet-form thin element extending from a corner portion on a tape side of said base plate toward said tape.

9. The bill handling apparatus according to claim 7, wherein said regulating device is movable in accordance with a change in an outer diameter of said wheel caused by winding said tape.

10. The bill handling apparatus according to claim 8, wherein said discharging device is movable in accordance with a change in an outer diameter of said wheel caused by winding said tape.

* * * * *